United States Patent [19]

Miller et al.

[11] Patent Number: 4,545,153

[45] Date of Patent: Oct. 8, 1985

[54] FORCE SENSOR FOR CONTROLLING POLISHING PAD PRESSURE

[75] Inventors: David A. Miller, Tustin; Leland R. Krueger, Costa Mesa; Richard J. Charlton, S. Laguna, all of Calif.

[73] Assignee: Charlton Associates, Irvine, Calif.

[21] Appl. No.: 560,417

[22] Filed: Dec. 12, 1983

[51] Int. Cl.[4] ..... B24B 7/04

[52] U.S. Cl. ..... 51/118; 5/165.77

[58] Field of Search ..... 51/111 R, 117, 118, 51/165.77, 165.8, 165.92

[56] References Cited

U.S. PATENT DOCUMENTS

| | | | |
|---|---|---|---|
| 3,100,954 | 8/1963 | Lella | 51/165.77 |
| 3,691,694 | 9/1972 | Goetz | 51/118 |
| 3,721,046 | 3/1973 | Dunn | 51/118 |
| 3,897,660 | 8/1975 | Chijiiwa | 51/165.92 |
| 3,913,277 | 10/1975 | Hahn | 51/165.92 |
| 3,939,610 | 2/1976 | Suzuki | 51/165.77 |
| 3,967,515 | 7/1976 | Nachtigel | 51/165.92 |
| 4,370,835 | 2/1983 | Schneidemesser | 51/111 R |

*Primary Examiner*—Harold D. Whitehead

*Attorney, Agent, or Firm*—Spensley Horn Jubas & Lubitz

[57] ABSTRACT

An apparatus for measuring and controlling the force exerted on a disc by a rotating pad. More specifically, the present invention relates to an apparatus for controlling the forces exerted by a plurality of polishing pads used for polishing the surfaces of rigid computer memory discs. The spring mechanism that provides the load force to a free sliding shaft which transmits the force to the polishing member is fitted with a suitable transducer, such as a strain gauge, which senses the axial force transmitted down the sliding shaft to the polishing pads by way of the force/strain relationship of the spring mechanism. The strain sensed by the transducer is converted to an electrial signal which is conducted to the input of a closed loop, feedback control servo system which maintains the desired contact force of the pads on the disc and, at the same time, maintains an equality of forces on each side of the disc.

2 Claims, 3 Drawing Figures

FORCE SENSOR FOR CONTROLLING POLISHING PAD PRESSURE

BACKGROUND OF THE INVENTION

1. Field of the Invention

The present invention relates to a force sensor for controlling polishing pad pressure and, more particularly, to an apparatus for controlling the force exerted by a polishing member upon a material being polished.

2. Description of the Prior Art

The present invention relates to the manufacture of rigid computer memory discs of the type which are used with a memory apparatus of a computer for storing data thereon. These discs are typically made of an aluminum alloy, having inner diameter of 1.576 inch, an outer diameter of 5.118 inches, and a thickness of 0.075 inch. The opposed surfaces of the discs are coated with a magnetic coating for memory use.

In the manufacture of such discs, as well as in the manufacture of other products, equipment is used to impart a super-fine finish to the disc surface. This equipment usually includes a polishing wheel or tape having in it a grit for metal removal, thereby causing the polishing action, with the grit held by a binder material forming the wheel or adhered to a plastic film forming the tape. The wheels are often called "pads" and these pads contact the disc face-to-face, rather than on edge. Moreover, pads are generally used in pairs, contacting both sides of the disc simultaneously. The intent is to exert equal forces on both sides of the disc so that the forces balance each other and do not distort the disc being polished. In operation, the pads are rotated, creating a polishing action on the disc face and the disc is also rotated, causing an even polishing action over the whole disc face.

A significant drawback to existing apparatus of this type is in the inability to adequately control the force exerted on the disc by the rotating pad. The apparatus presently used for applying force through the rotating pad to the disc is typically spring-loaded, free sliding shafts, where the motion of the sliding shaft compresses a spring which in turn applies the force to the pad. Another apparatus applies air pressure to a gland which acts over an area of a flange, creating a force on the pad, in effect acting as an air spring In both cases, the force exerted on the disc by the rotating pad cannot be controlled and, most importantly, it is not possible to maintain an equal force on each side of the disc. With unequal polishing forces, the disc being polished is often distorted.

SUMMARY OF THE INVENTION

According to the present invention, there is provided an apparatus for measuring and controlling the force exerted on a disc by a rotating pad. While the present invention will be described as applicable to pads, the concept is equally applicable to tapes or wheels. By use of the present apparatus, not only can the force exerted by a polishing member upon a material be accurately controlled, but the forces applied to opposite sides of a material being polished can be balanced so that the material is not distorted.

According to the present invention, the spring mechanism that provides the load force to a free sliding shaft (which transmits the force to the polishing member) is fitted with a suitable transducer, such as a strain sensor, which senses the axial force transmitted down the sliding shaft to the pad by way of the force/strain relationship of the spring mechanism. The details of the connection of the spring mechanism to the sliding shaft are such that the strain can be sensed by the transducer whether the sliding shaft is rotating or not.

The strain sensed by the transducer is converted to an electrical signal which is conducted to the input of a closed loop, feedback control servo system which maintains the desired contact force of the pad on the disc and, at the same time, maintains an equality of forces on each side of the disc.

The objects, features and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

DESCRIPTION OF THE PREFERRED EMBODIMENT

Figure 1:
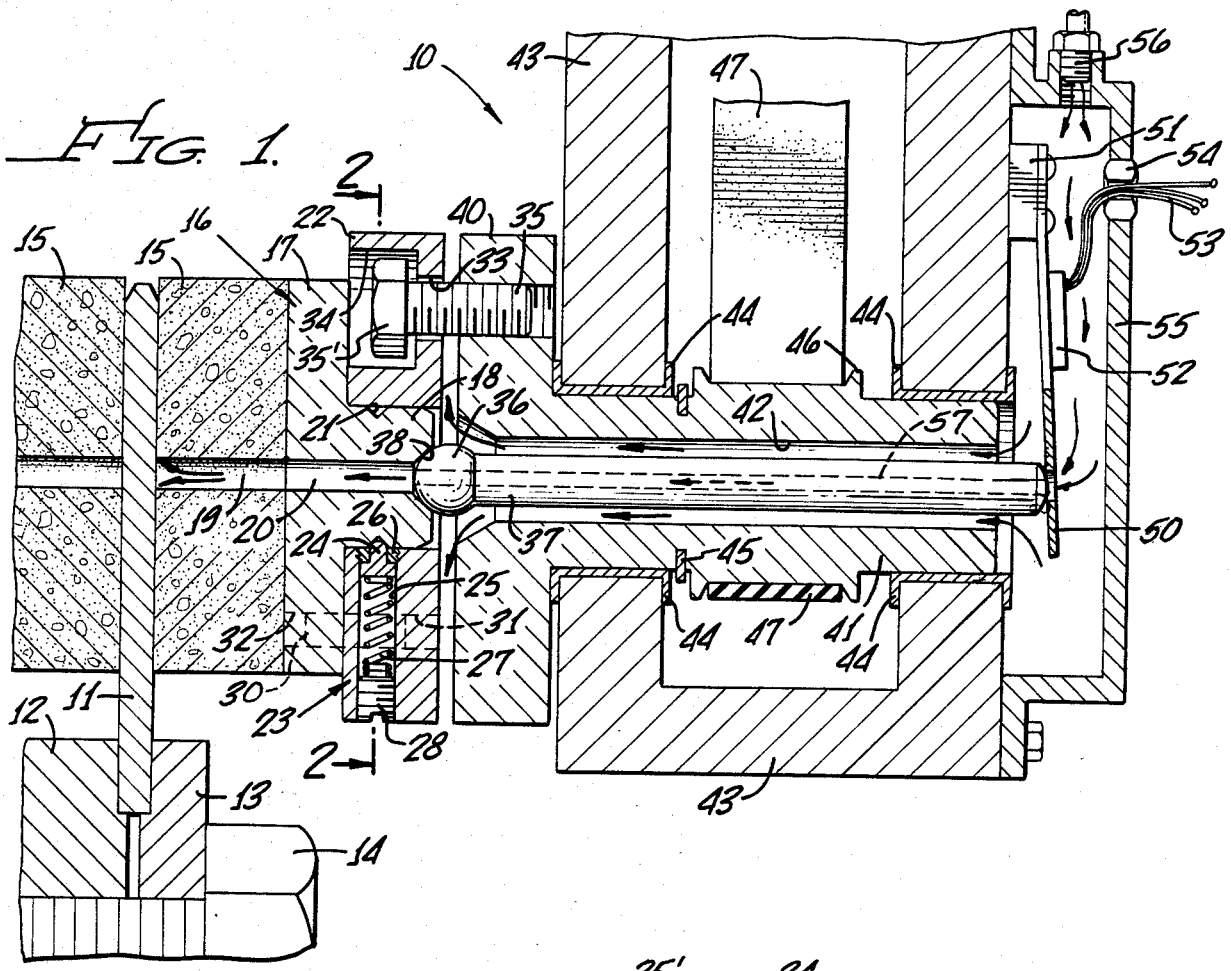
FIG. 1 is a side sectional view of the present apparatus for controlling the force exerted by a polishing member material being polished.
Figure 2:
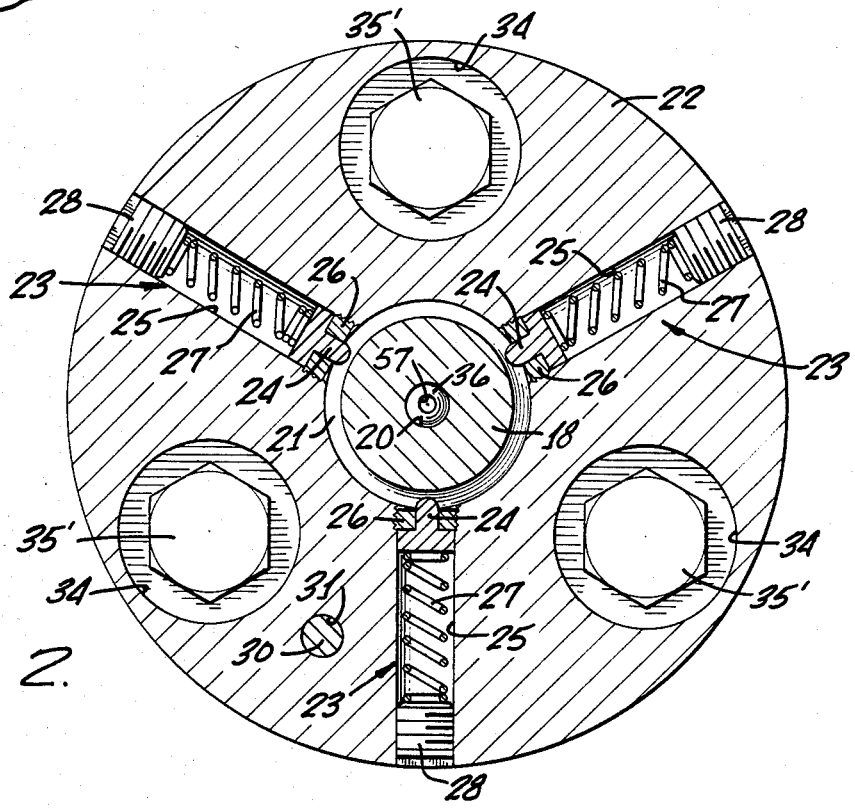
FIG. 2 is an enlarged sectional view taken along the line 2—2 FIG. 1.

Referring now to the drawings and, more particularly, to FIGS. 1 and 2 thereof, the present apparatus generally designated 10, for measuring and controlling the force exerted by a polishing member upon a material being polished will be described in its preferred embodiment wherein a rigid computer memory disc 11 has the opposed surfaces thereof polished for ultimate use with a memory apparatus of a computer for storing data thereon. FIG. 1 shows a disc blank 11 as it would be provided at an appropriate stage in the manufacturing process. Disc 11 is clamped to a rotating spindle 12 by a clamp 13 and a screw 14. The clamping of disc 11 to spindle 12 is described more fully in co-pending application Ser. No. 560416, filed concurrently herewith in the name of Richard J. Elliott, entitled Rigid Computer Memory Disc Manufacturing Method and assigned to Charlton Associates, the assignee of the present invention. Spindle 12 is rotated by suitable means (not shown) so as to cause an even polishing action over the whole disc face.

Disc 11 is positioned between two identical polishing pads 15. Since the apparatus 10 for supporting and driving pads 15 is identical, only the apparatus 10 attached to one of pads 15 will be shown and described in detail.

Pad 15 is a disc-shaped member, one side of which makes surface contact with one side surface of disc 11. The other side of pad 15 is bonded to a backing member 16. Backing member 16 is a generally cylindrical member having a first section 17 which has an outside diameter equal to the outside diameter of polishing pad 15 and a second section 18 of reduced outside diameter. It should also be noted that both pad 15 and backing member 16 have axial channels 19 and 20, respectively, therein for reasons which will appear more fully hereinafter. Section 18 of backing member 16 also has a circumferential groove 21 therein.

Backing member 16 is removably connected to a disc-shaped gimbal plate 22 which supports backing member 16 and polishing pad 15 for limited axial movement. More specifically, gimbal plate 22 has an inside diameter which is slightly greater than the outside diameter of section 18 of backing member 16 and section 18 of backing member 16 extends into the center of gimbal plate 22. A plurality of ball-spring plunger assemblies 23 extending around gimbal plate 22 each include a spring-biased ball 24 which extends into groove 21 in section 18 of backing member 16 to releasably retain backing member 16 within gimbal plate 22. Each assembly 23 is mounted within a radial bore 25 which extends through gimbal plate 22. At the inner end of bore 25 is a ball retainer 26 which allows ball 24 to partially extend into the central opening in gimbal plate 22. A spring 27 biases ball 24 in this position, spring 27 extending between ball 24 and a set screw 28 mounted in the internally threaded outer end of bore 25.

A drive pin 30 mounted within an axial bore 31 in gimbal plate 22 extends into an axial bore 32 in backing member 16 so that rotation of gimbal plate 22, as will be described more fully hereinafter, causes rotation of backing member 16 and polishing pad 15.

Gimbal plate 22 also has a plurality of axial bores 33 which extend partially therethrough and a plurality of coaxial enlarged bores 34 which also extend partially therethrough. This arrangement permits a plurality of retaining screws 35 to be extended through bores 33 with the heads 35' of screws 35 positioned within bores 34. The purpose of retaining screws 35 is simply to limit the axial movement of gimbal plate 22.

Gimbal plate 22 and backing member 16 are free to gimbal along with pad 15 itself around a spherical ball tip 36 which is connected to one end of a shaft 37 and which extends into a central cone-shaped socket 38 at the outer end of section 18 of backing member 16. As should be evident from an inspection of FIG. 1, the gimbaling action is limited by the restraint of retaining screws 35. The heads 35' of retaining screws 35 capture gimbal plate 22 and screws 35 extend into a disc-shaped plate 40 connected to one end of a drive shaft 41. Plate 40 is made integral with shaft 41 and a central channel 42 extends axially therethrough, shaft 37 extending through channel 42.

Apparatus 10 includes a housing assembly 43, only the relevant portion of which is shown in FIG. 1. Shaft 41 is supported by a pair of bearings 44 in housing 43. Axial movement of shaft 41 relative to housing 43 is prevented by means of plate 40 which rests on one end of one of bearings 44 and suitable means, such as a snap ring 45, connected to shaft 41 and engaging the other end of the same bearing 44.

A pulley 46 is attached to shaft 41 for transmitting a rotational torque from a belt 47 to shaft 41. Belt 47 is driven by a suitable means such as an electric motor (not shown).

Shaft 37 is freely slidable within channel 42 in drive shaft 41 and may or may not rotate. The end of shaft 37 opposite from ball tip 36 is butted up against one end of a flat leaf spring 50, the other end of which is anchored by a suitable means 51 to housing 43. In this manner, leaf spring 50 applies an axial force to shaft 37 which in turn presses ball tip 36 into socket 38 in backing member 16. This force is transferred from backing member 16 to polishing pad 15 which presses on disc 11 to be polished.

The tension on leaf spring 50 is controlled by the positioning of the entire housing assembly 43 which is moved either closer to or away from disc 11 by a suitable motor (not shown in FIG. 1) to be described more fully hereinafter. For example, as housing assembly 43 moves closer to disc 11, polishing pad 15, backing member 16, ball tip 36 and free sliding shaft 37 are all in a relatively fixed position relative to disc 11 and the opposing pad 15 on the opposite side of disc 11. Thus, shaft 37 increases the tension on leaf spring 50 as housing assembly 43 moves toward disc 11. Evidentally, the opposite effect is achieved as housing assembly 43 moves away from disc 11.

The tension of leaf spring 50 is sensed by a suitable transducer, such as a strain gauge 52 bonded thereto or a piezoelectric strain sensitive crystal (not shown) or any other of a number of means apparent to those skilled in the art. Strain gauge 52 has electrical connection wires 53 which are brought out through a port 54 in a cover 55, which is secured to the back of housing member 43, for connection to the signal processing circuitry to be described hereinafter.

A polishing fluid useful for the manufacturing operation is introduced into cover 55 through a port 56 therein. From the chamber formed by cover 55, the polishing fluid flows through a central hole 57 in free sliding shaft 37, through spherical ball tip 36 and into channels 19 and 20 in polishing pad 15 and backing member 16, respectively. From here, the polishing fluid is conducted to the surface of disc 11. The polishing fluid also flows around the outside of shaft 37 and discharges out between gimbal plate 22 and plate 40 of shaft 41. The fluid flow onto disc 11 aids in the polishing process and purges the disc surface of the swarf, while the fluid flow around the outside of shaft 37 provides lubrication for and, in a sense, floats shaft 37 inside shaft 41. The polishing fluid also purges bearings 44 of harmful grit and swarf.

Figure 3:
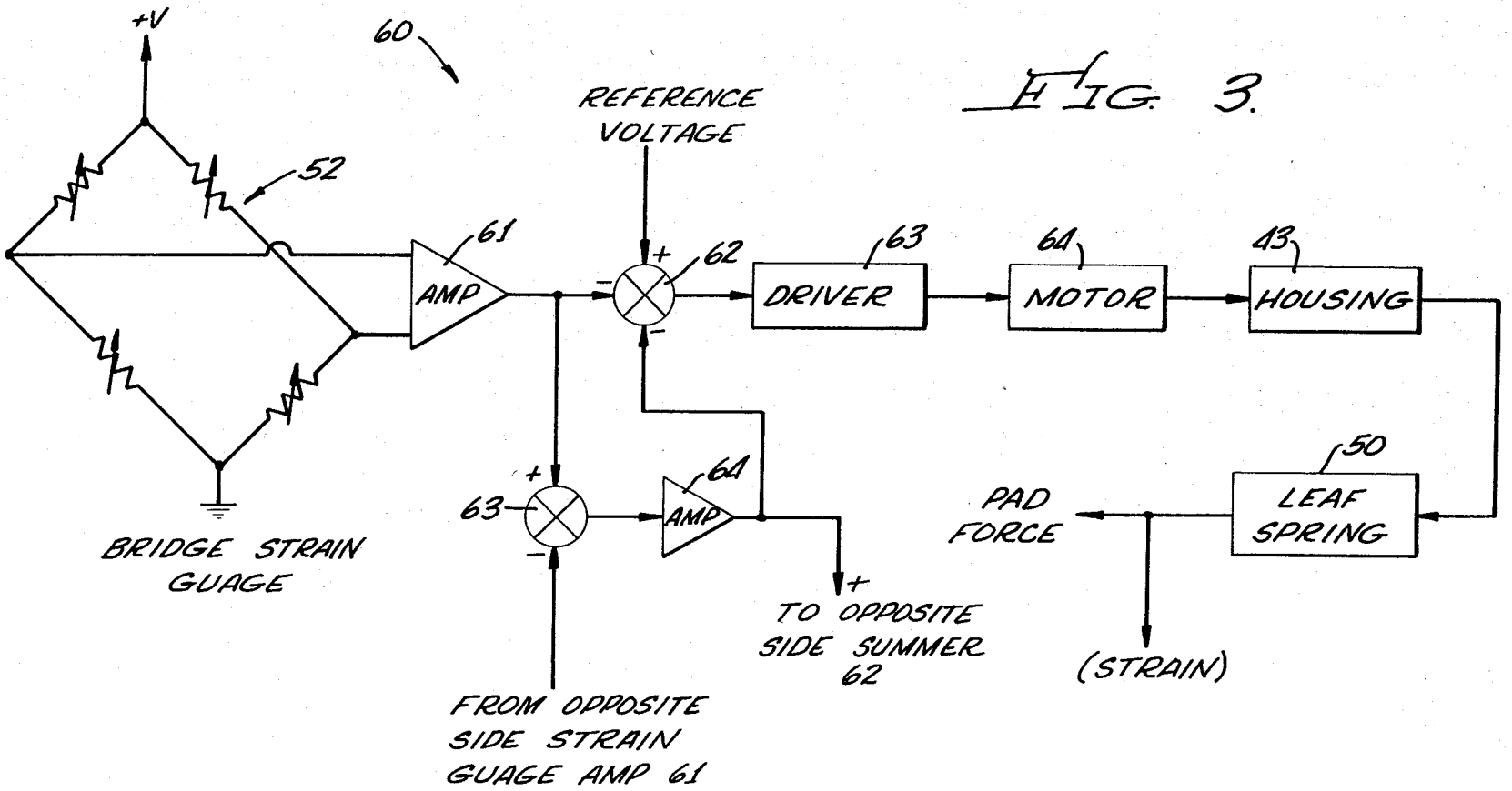
FIG. 3 is a block diagram of a servo control system for controlling the force of the polishing members on the material being polished.

Referring now to FIG. 3, there is shown the servo control circuitry, generally designated 60, that employs the output of strain gauge 52 to control the force of pad 15 on disc 11. It will again be mentioned that there is identical apparatus 10 on the opposite side of disc 11 so that all portions of servo control circuitry 60 except summer 63 and amplifier 64 are duplicated for controlling the opposite side apparatus 10. The two control circuits 60 are also cross-connected, by means of summer 63 and amplifier 64, for reasons which will appear more fully hereinafter.

Strain gauge 52 is a conventional bridge strain gauge connected between a source of positive voltage $+V$ and circuit ground and the output of the bridge is applied to a differential amplifier 61. The output of amplifier 61 is applied as a negative input to a summer 62 which receives as a positive input from a reference voltage. The output of amplifier 61 is also applied as a positive input to a summer 63 which receives as a negative input the output of the amplifier 61 (not shown) connected to the opposite side strain gauge (not shown). The output of summer 63 is applied to an amplifier 64 which provides a signal which is applied as a negative input to summer 62 and a positive input to the summer 62 (not shown) of the opposite side circuitry (not shown). The output of summer 62 is connected to a driver 63 which activates a motor 64 which is connected to housing 43 for driving housing 43 axially, as described previously. Housing 43 moves leaf spring 50 therewith which affects the pad force and the signal sensed by strain gauge 52.

In operation, a voltage is applied to summer 62 which corresponds to a desired force of pad 15 on disc 11. This voltage is processed by driver 63 and applied to motor 64 which moves housing assembly 43 toward or away from pad 15. This action causes pad 15 and shaft 37 to bend leaf spring 50, the strain induced therein being sensed by strain gauge 52 and amplified by differential amplifier 61. When the desired pad force is achieved, the amplified output from strain gauge 52 just equals the desired input voltage at summer 62 so that no further action by motor 64 results.

Should the pad force increase or decrease during the polishing operation, that condition will be sensed by strain gauge 52, causing corrective action by motor 64 of a proper polarity to restore the pad force to the correct value. It is apparent to those skilled in the art that the input voltage corresponding to the desired pad force may be varied during the polishing operation to achieve whatever result may be desired.

Moreover, if one pad 15 should have a larger or smaller force than the opposite one, corrective action is taken to restore equality. Equality is restored by taking the difference between each strain gauge amplifier 61 at summer 63, which difference signal is amplified by amplifier 64 and conducted to the summer 62 of each pad circuit but combined as opposite signs. Thus, the pad force that is larger has its motor retarded by the difference signal and the pad force that is smaller has its motor increased and vice versa, restoring pad force equality. Pad force equality is important during the time pads 15 are being loaded onto disc 11 as well as during the polishing process.

It can therefore be seen that according to the present invention, there is provided an apparatus for measuring and controlling the force exerted on a disc by a rotating pad. By use of the present apparatus, not only can the force exerted by a polishing member upon a material be accurately controlled, but the forces applied to opposite sides of the material being polished can be balanced so that the material is not distorted.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

We claim:

1. An apparatus for controlling and equalizing the forces exerted by first and second polishing members on opposite sides of a material being polished comprising:

first and second rotary polishing members for engaging opposite sides of said material;

first and second means for supporting said first and second polishing members, respectively, for rotary and axial movement;

first and second housing means;

first and second means mounted in said first and second housing means, respectively, and connected to said first and second supporting means, respectively, for rotatively driving said polishing members;

first and second means positioned between said first and second housing means, respectively, and said first and second polishing members, respectively, for applying axial forces to said polishing members;

first and second transducer means operatively coupled to said first and second force applying means, respectively, for sensing the forces applied by said force applying means to said polishing members and for generating first and second electrical signals, respectively, proportional thereto; and means responsive to said first and second transducer means for moving said first and second housing means axially to control the forces exerted by said polishing members upon said material, said moving means moving said housing means axially to equalize the forces exerted by said first and second polishing members on opposite sides of said material.

2. An apparatus according to claim 1, wherein said moving means comprises:

first and second drive means for moving said first and second housing means, respectively, axially; and a closed loop feedback control circuit responsive to said electrical signals from said transducer means and an electrical reference signal for activating said drive means to move said housing means in a direction to eliminate any difference between said electrical reference signal and each of said transducer means signals and any difference between the signals from said first and second transducer means.

* * * * *